US007776391B2

(12) United States Patent
Teng et al.

(10) Patent No.: US 7,776,391 B2
(45) Date of Patent: Aug. 17, 2010

(54) VARIABLE THICKNESS SHINGLES

(75) Inventors: Yihsien H Teng, Westerville, OH (US); Sanjay Mansukhani, Lewis Center, OH (US)

(73) Assignee: Owens Corning Intellectual Capital, LLC DE (US)

( * ) Notice: Subject to any disclaimer, the term of this patent is extended or adjusted under 35 U.S.C. 154(b) by 776 days.

(21) Appl. No.: 11/648,078

(22) Filed: Dec. 30, 2006

(65) Prior Publication Data

US 2008/0160188 A1 Jul. 3, 2008

(51) Int. Cl.
*B05D 1/12* (2006.01)
*B05D 3/12* (2006.01)

(52) U.S. Cl. ..... 427/188; 427/186; 427/365

(58) Field of Classification Search ..... 427/186–188, 427/365

See application file for complete search history.

(56) References Cited

U.S. PATENT DOCUMENTS

| | | | | |
|---|---|---|---|---|
| 1,412,828 | A | 4/1922 | Beckman et al. | |
| 1,913,475 | A | 6/1933 | Conant | |
| 2,233,122 | A * | 2/1941 | Burns | 427/188 |
| 4,028,450 | A | 6/1977 | Gould | |
| 4,191,722 | A | 3/1980 | Gould | |
| 4,352,837 | A | 10/1982 | Kopenhaver | |
| 4,717,614 | A | 1/1988 | Bondoc et al. | |
| 4,795,661 | A | 1/1989 | Bondoc et al. | |
| 6,471,812 | B1 | 10/2002 | Thompson et al. | |
| 6,692,608 | B2 | 2/2004 | Phillips | |
| 6,521,076 | B1 | 2/2007 | Elliott | |
| 2005/0252137 | A1 | 11/2005 | Bartek et al. | |
| 2008/0086970 | A1 * | 4/2008 | Teng et al. | 52/518 |

* cited by examiner

*Primary Examiner*—Frederick J Parker
(74) *Attorney, Agent, or Firm*—James J. Dottavio

(57) ABSTRACT

A method of manufacturing roofing shingles comprises the steps of: coating a continuously supplied shingle mat with roofing asphalt to make an asphalt-coated sheet, the asphalt-coated sheet having at least one prime portion and at least one headlap portion, varying the thickness of the asphalt-coated sheet such that the at least one prime portion of the asphalt-coated sheet has a first thickness and the headlap portion has a second thickness, the thickness of the asphalt-coated sheet being varied by passing the asphalt-coated sheet through compression rollers, applying granules onto the asphalt-coated sheet to form a granule-covered sheet, and cutting the granule-covered sheet into shingles.

23 Claims, 9 Drawing Sheets

VARIABLE THICKNESS SHINGLES

TECHNICAL FIELD

This invention relates to roofing shingles. More particularly, this invention relates to roofing shingles manufactured with more efficient use of raw materials.

BACKGROUND OF THE INVENTION

A common method for the manufacture of asphalt shingles is the production of a continuous strip of asphalt shingle material followed by a shingle cutting operation which cuts the material into individual shingles.

In the production of the continuous strip of asphalt shingle material, a substrate such as an organic felt or a glass fiber mat is passed into contact with a coater containing liquid asphalt to form a tacky asphalt coated strip. Subsequently, the hot asphalt coated strip is passed beneath one or more granule applicators which apply the protective surface granules to portions of the asphalt coated strip to form a granule coated sheet. The granule coated sheet is cooled and subsequently cut into individual shingles.

In the manufacturing process, the asphalt coated strip is conceptually divided into an equal number of prime lanes, and headlap lanes. The prime lanes receive an application of prime granules while the headlap lanes receive an application of headlap granules. It would be advantageous if shingles could be manufactured with more efficient use of raw materials.

SUMMARY OF THE INVENTION

The above objects as well as other objects not specifically enumerated are achieved by a method of manufacturing roofing shingles. The method comprises the steps of: coating a continuously supplied shingle mat with roofing asphalt to make an asphalt-coated sheet, the asphalt-coated sheet having at least one prime portion and at least one headlap portion, varying the thickness of the asphalt-coated sheet such that the at least one prime portion of the asphalt-coated sheet has a first thickness and the headlap portion has a second thickness, the thickness of the asphalt-coated sheet being varied by passing the asphalt-coated sheet through compression rollers, applying granules onto the asphalt-coated sheet to form a granule-covered sheet, and cutting the granule-covered sheet into shingles.

According to this invention there is also provided a method of manufacturing roofing shingles. The method comprises the steps of: coating a continuously supplied shingle mat with roofing asphalt to make an asphalt-coated sheet, the asphalt-coated sheet having at least one prime portion and at least one headlap portion, varying the thickness of the asphalt-coated sheet such that the at least one prime portion of the asphalt-coated sheet has a first thickness and the headlap-portion has a second thickness, the thickness of the asphalt-coated sheet being varied by passing the asphalt-coated sheet under an auxiliary coater, applying granules onto the asphalt-coated sheet to form a granule covered sheet, and cutting the granule-covered sheet into shingles.

According to this invention there is also provided a method of manufacturing roofing shingles. The method comprises the steps of: coating a continuously supplied shingle mat with roofing asphalt to make an asphalt-coated sheet, the asphalt-coated sheet having at least one prime portion and at least one headlap portion, varying the thickness of the asphalt-coated sheet such that the at least one prime portion of the asphalt-coated sheet has a first thickness and the headlap portion has a second thickness, applying a film to the at least one headlap portion of the asphalt-coated sheet, applying granules onto the at least one prime portion of the asphalt-coated sheet, and cutting the sheet into shingles.

According to this invention there is also provided an apparatus for manufacturing roofing shingles, the roofing shingles having at least one prime portion and at least one headlap portion. The apparatus comprises an asphalt coater configured to receive a shingle mat traveling in a machine direction. The asphalt coater is configured to coat the shingle mat with asphalt. At least one compression roller is positioned downstream from the asphalt coater. The at least one compression roller is configured to receive and compress the asphalt-coated sheet to the extent that excess asphalt is squeezed from the asphalt-coated sheet and the at least one prime portion of the asphalt-coated sheet forms a first thickness and the headlap portion forms a second thickness. At least one granule blender is positioned downstream from the at least one compression roller. The at least one granule blender is configured to apply granules onto the asphalt-coated sheet. A drum is positioned downstream from the at least one granule blender. The drum is configured to press the granules into the granule-covered sheet and remove the granules which are not adhered to the granule-covered sheet. A cutter is positioned downstream from the at least one granule blender. The cutter is configured to cut the granule-covered sheet into shingles.

According to this invention there is also provided an apparatus for manufacturing roofing shingles, the roofing shingles having at least one prime portion and at least one headlap portion. The apparatus comprises an asphalt coater configured to receive a shingle mat traveling in a machine direction. The asphalt coater is configured to coat the shingle mat with asphalt. At least one auxiliary coater is positioned downstream from the asphalt coater. The at least one auxiliary coater is configured to receive the shingle mat traveling in the machine direction and impart additional asphalt material onto the shingle mat such that the at least one prime portion of the asphalt-coated sheet forms a first thickness and the headlap portion forms a second thickness. At least one granule blender is positioned downstream from the at least one auxiliary coater. The at least one granule blender is configured to apply granules onto the asphalt-coated sheet. A drum is positioned downstream from the at least one granule blender. The drum is configured to press the granules into the granule-covered sheet and remove the granules which are not adhered to the granule-covered sheet. A cutter is positioned downstream from the at least one granule blender. The cutter is configured to cut the granule-covered sheet into shingles.

According to this invention there is also provided an apparatus for manufacturing roofing shingles, the roofing shingles having at least one prime portion and at least one headlap portion. The apparatus comprises an asphalt coater configured to receive a shingle mat traveling in a machine direction. The asphalt coater is configured to coat the shingle mat with asphalt. At least one compression roller is positioned downstream from the asphalt coater. The at least one compression roller is configured to receive and compress the asphalt-coated sheet to the extent that excess asphalt is squeezed from the asphalt-coated sheet and the at least one prime portion of the asphalt-coated sheet forms a first thickness and the headlap portion forms a second thickness. At least one film application unit is positioned downstream from the at least one compression roller. The at least one film application unit is configured to receive the shingle traveling in the machine direction and apply a film to the at least one headlap portion of the asphalt-coated sheet. At least one granule blender is positioned downstream from the at least one film application unit. The at least one granule blender is configured to apply granules onto the asphalt-coated sheet. A drum is positioned downstream from the at least one granule blender. The drum is configured to press the granules into the granule-covered sheet and remove the granules which are not adhered to the granule-covered sheet. A cutter is positioned downstream from the at least one granule blender. The cutter is configured to cut the granule-covered sheet into shingles According to this invention there is also provided a method of manufacturing roofing shingles. The method comprises the steps of: coating a continuously supplied shingle mat with roofing asphalt to make an asphalt-coated sheet, the asphalt-coated sheet having at least one prime portion and at least one headlap portion, passing the asphalt-coated sheet through a thickness control mechanism such that the at least one prime portion of the asphalt coated-sheet has a prime portion weight and the headlap portion has a headlap portion weight, measuring the weight of the at least one prime portion and the at least one headlap portion in both the machine direction and the cross machine direction downstream from the thickness control mechanism, adjusting the thickness control mechanism to control the weight of the asphalt-coated sheet to achieve a desired weight, applying granules onto the at least one prime portion of the asphalt-coated sheet, and cutting the granule-covered sheet into shingles.

Various objects and advantages of this invention will become apparent to those skilled in the art from the following detailed description of the invention, when read in light of the accompanying drawings.

DETAILED DESCRIPTION OF THE INVENTION

Composite shingles, such as asphalt shingles, are a commonly used roofing product. Asphalt shingle production generally includes feeding a base material from an upstream roll and coating it first with a filled roofing asphalt material, then a layer of granules. The base material is typically made from a fiberglass mat provided in a continuous shingle membrane or sheet. It should be understood that the base material can be any suitable support material.

The filled roofing asphalt material is added to the continuous shingle membrane for strength and improved weathering characteristics. It should be understood that the filled roofing asphalt material can include any suitable material, preferably low in cost, durable, and resistant to fire.

Composite shingles typically have a headlap region and a prime region. The headlap region may be ultimately covered by adjacent shingles when installed upon a roof. The prime region will be ultimately visible when the shingles are installed upon a roof.

The granules deposited on the composite material shield the filled roofing asphalt material from direct sunlight, offer resistance to fire, and provide texture and color to the shingle. The granules generally involve at least two different types of granules. Headlap granules are applied to the headlap region. Headlap granules are relatively low in cost and primarily serve the functional purposes of protecting the underlying asphalt material, balancing sheet weight and preventing overlapping shingles from sticking to one another. Colored granules or other prime granules are relatively expensive and are applied to the shingle at the prime regions. Prime granules are disposed upon the asphalt strip for both the functional purpose of protecting the underlying asphalt strip and for the purpose of providing an aesthetically pleasing appearance of the roof.

The layers of granules are typically applied with one or more granule applicators, such as pneumatic blenders, to the asphalt material covering the continuous shingle membrane. The pneumatic blender is a type of granule applicator known in the art. The granules can be applied to the continuous shingle membrane in color patterns to provide the shingles with an aesthetically pleasing appearance. The granules optionally can include anti-microorganism granules, such as copper granules, to inhibit the growth of algae, fungus, and/or other microorganisms.

Figure 1:
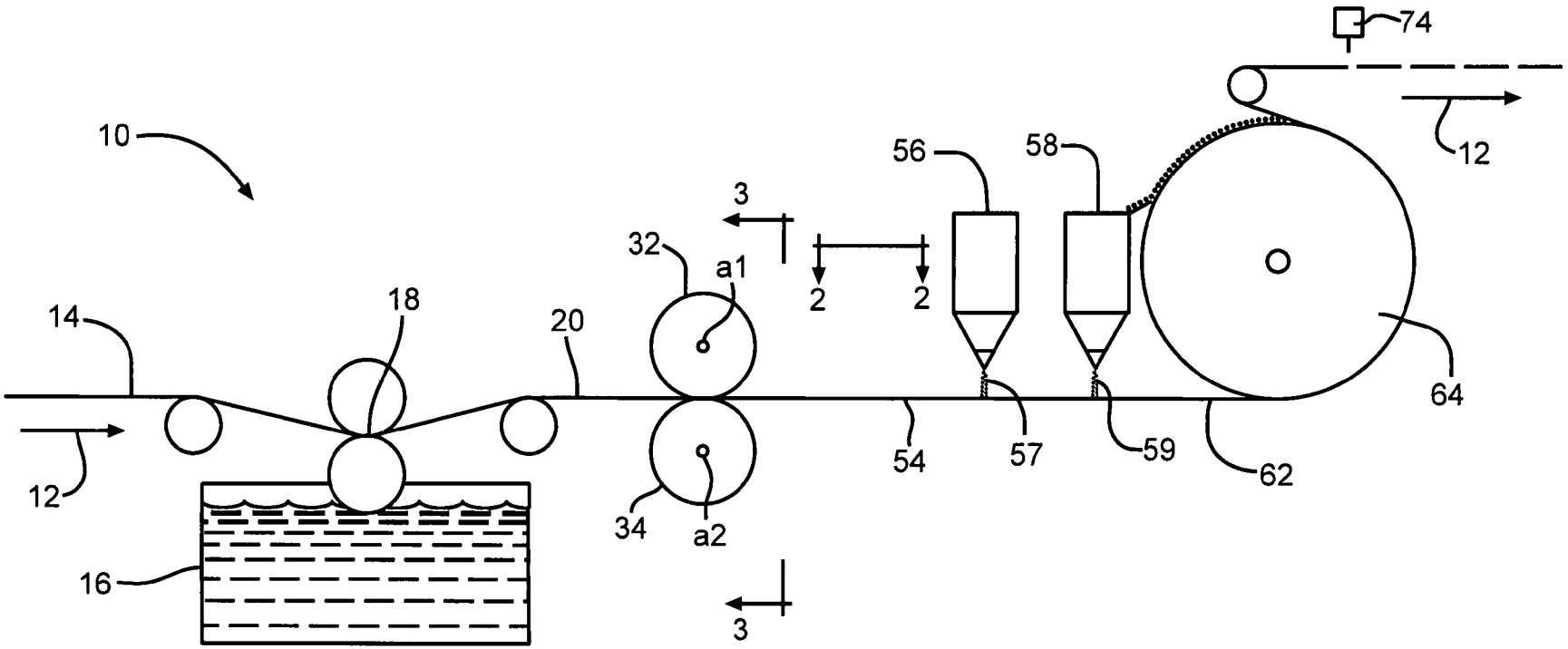
FIG. 1 is a schematic elevational view, partially in cross section, of a portion of an apparatus for making shingles according to the method of the invention.

The description and drawings disclose a method for manufacturing an asphalt shingle having a variable thickness. Referring now to the drawings, there is shown in FIG. 1 an apparatus 10 for manufacturing asphalt-based shingles according to the invention. The illustrated manufacturing process involves passing a continuous sheet in a machine direction (indicated by an arrow 12) through a series of manufacturing operations. The sheet usually moves at a speed from about 300 feet/minute to about 800 feet/minute. However, other speeds can be used.

In a first step of the manufacturing process, a continuous sheet of shingle mat 14 is payed out from a roll (not shown). The shingle mat 14 can be any type of substrate known for use in reinforcing asphalt-based roofing shingles, such as a non-woven web of glass fibers. The shingle mat 14 is fed through a coater 16 where a coating of asphalt 18 is applied to the top and bottom of the shingle mat 14. The asphalt coating 18 can be applied in any suitable manner. In the illustrated embodiment, the shingle mat 14 contacts a supply of hot, melted asphalt 18 to completely cover the shingle mat 14 with a tacky coating of asphalt 18. However, in other embodiments, the asphalt coating 18 could be sprayed on, rolled on, or applied to the shingle mat 14 by other means. Typically the filled roofing asphalt material is highly filled with a ground mineral filler material, amounting to at least about 60 percent by weight of the asphalt/filler combination. The shingle mat 14 exits the coater 16 as an asphalt-coated sheet 20. The asphalt coating 18 on the asphalt-coated sheet 20 remains hot.

Figure 2:
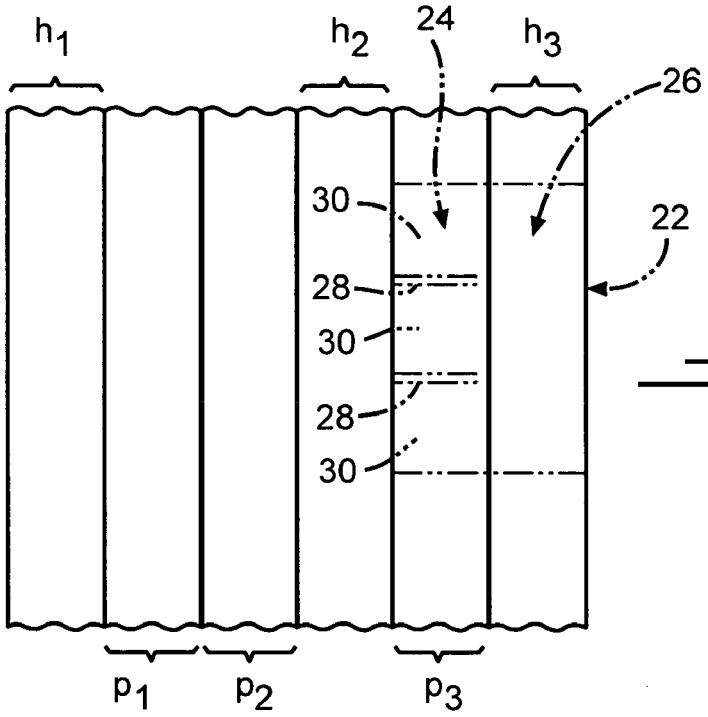
FIG. 2 is a schematic plan view of a portion of the apparatus illustrated in FIG. 1, taken along the line 2-2, showing a portion of the asphalt-coated sheet.

The asphalt-coated sheet 20 is shown in more detail in FIG. 2. As shown, the asphalt-coated sheet 20 for the three-wide apparatus 10 comprises six distinct regions or lanes including three headlap lanes h1, h2, and h3, and three prime lanes p1, p2, and p3. An exemplary roofing shingle is shown by a phantom line 22 and may be cut from asphalt-coated sheet 20 as shown. In this manner, three roofing shingles of any length desired may be cut from each such length of asphalt-coated sheet 20. Each shingle 22 would contain one headlap lane h1, h2, or h3, and one respective adjacent prime lane p1, p2, or p3. Accordingly, the shingle 22 includes a headlap region 26 and a prime region 24.

The headlap region 24 of the shingle 22 is that portion which is covered by adjacent shingles when the shingle 22 is ultimately installed upon a roof. The prime region 26 of the shingle 22 is that portion which remains exposed when the shingle 22 is ultimately installed upon a roof.

In this embodiment, the shingle 22 is cut from the asphalt-coated sheet 20 to be approximately three feet long by one foot wide. As further shown in FIGS. 2 and 6, the shingle 22 includes two cut-out regions 28 which define three tabs 30. It will be apparent to one skilled in the art that the asphalt-coated sheet 20 may be manufactured having a wide variety of widths to allow different numbers of shingles to be cut therefrom. For example, some roofing shingle manufacturing plants use an asphalt-coated sheet (not shown) which is sufficiently wide to allow four or more one-foot wide shingles to be cut therefrom. Such a wider asphalt-coated sheet would include an additional headlap region, and an additional prime region. One skilled in the art will also recognize that roofing shingles of different sizes, i.e. roofing shingles having different lengths and/or widths, may be cut from the asphalt-coated sheet 20.

Figure 5:
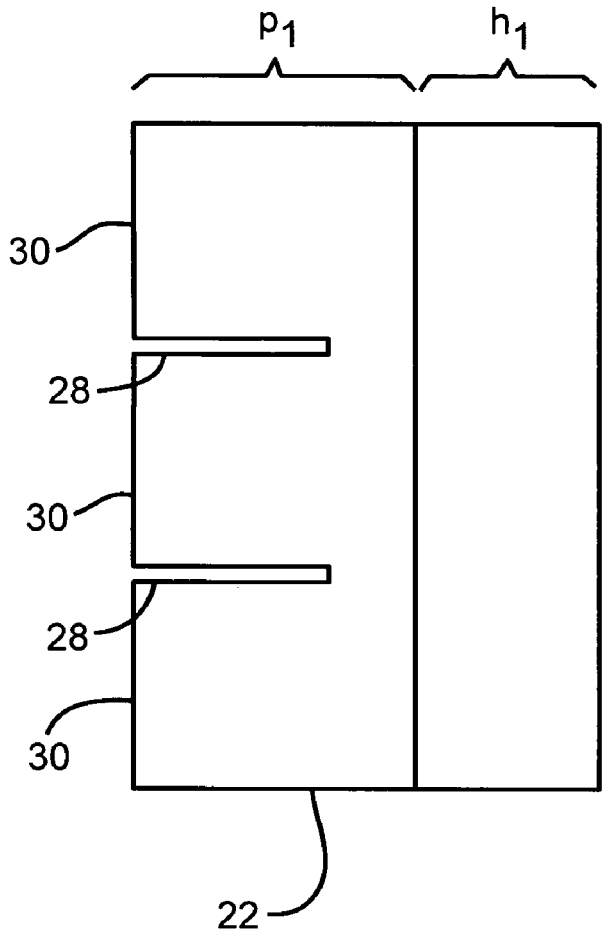
FIG. 5 is a plan view, in elevation, of a shingle according to one embodiment of the invention.

As will be appreciated by one skilled in the art, while the Figures illustrate a 3-tab strip shingle such as that shown in FIG. 5 and process/apparatus for manufacturing such a strip shingle, the same principles may be applied to a laminated shingle; i.e. the headlap portion of the laminate shingle may be thinner than the tab region, or vice-versa. Furthermore, any of the overlay and/or underlay and/or headlap regions of the laminated shingle may be thinned according the principles of the instant invention to accomplish reduction of asphalt in unnecessary regions. In one such embodiment, the instant invention is used to remove excess asphalt from between the layers of the laminated region of the shingle in the exposed area of the laminate shingle.

The resulting asphalt-coated sheet 20, including headlap lanes h1, h2 and h3 and prime lanes, p1, p2 and p3, is then passed between a top compression roll 32 and a bottom compression roll 34. In this embodiment, the top compression roll 32 is a drum rotating about axis a1. Similarly, the bottom compression roll 34 is a drum rotating about axis a2. Referring again to FIG. 1, as the asphalt-coated sheet 20 feeds between the top compression roll 32 and the bottom compression roll 34, the asphalt-coated sheet 20 is compressed and excess asphalt is squeezed from the asphalt-coated sheet 20. The excess asphalt is the returned to the coater 16. In an alternative embodiment (not shown), the compression rolls 32, 34 are provided at the applicator 18, versus the downstream position as shown in the Figures, thereby eliminating a set of rollers.

Figure 3:
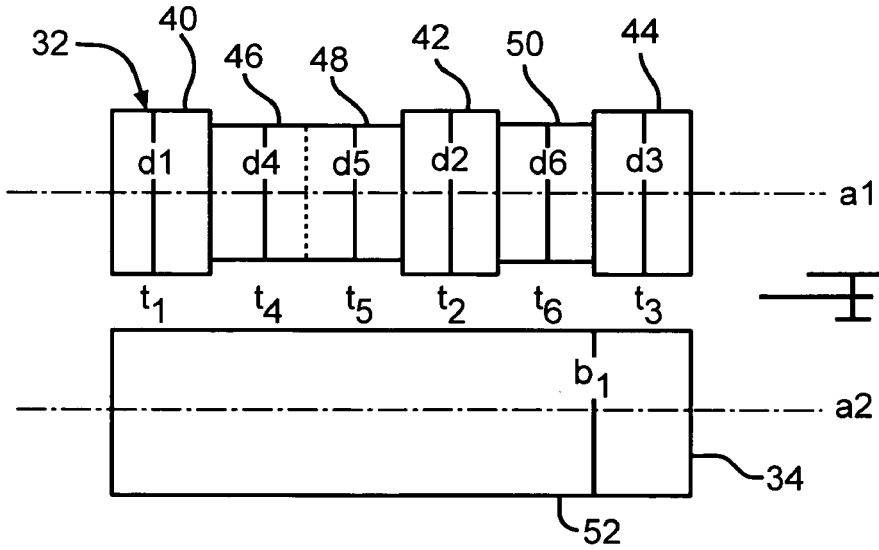
FIG. 3 is a side elevational view of the compression rolls, taken along the line 3-3, of FIG. 1.

As shown in FIG. 3, the top compression roll 32 comprises different roll regions having different roll diameters that correspond to the headlap and prime lanes of the asphalt-coated sheet 20. In this embodiment, the top compression roll 32 includes roll regions 40, 42 and 44. Roll region 40 has a roll diameter d1, roll region 42 has a roll diameter d2 and roll region 44 has a roll diameter d3. The top compression roll 32 also includes roll regions 46, 48 and 50. Roll region 46 has a roll diameter d4, roll region 48 has a roll diameter d5 and roll region 50 has a roll diameter d6.

In this embodiment as further shown in FIG. 3, the bottom compression roll 34 has a bottom roll region 52. The bottom roll region 52 extends across the entire width of the roll 34. The bottom roll region 52 has a bottom roll diameter b1.

In operation, as the asphalt-coated sheet 20 passes between the top compression roll 32 and the bottom compression roll 34, headlap lane h1 of the asphalt-coated sheet 20 passes between roll region 40 of the top compression roll 32 and roll region 52 of the bottom compression roll 34. As the headlap lane h1 passes between roll region 40 of the top compression roll 32 and roll region 52 of the bottom compression roll 34, headlap lane hl is compressed to thickness t1. In a similar manner, as headlap lanes h2 and h3 pass between roll regions 42 and 44 of the top compression roll 32 and roll region 52 of the bottom compression roll 34, headlap lanes h2 and h3 are compressed to thicknesses t2 and t3, respectfully. Also in a similar manner, as prime lanes p1, p2 and p3 pass between roll regions 46, 48 and 50 of the top compression roll 32 and roll region 52 of the bottom compression roll 34, prime lanes p1, p2 and p3 are compressed to thicknesses t4, t5 and t6, respectfully. In this embodiment as shown in FIG. 3, the d1, d2 and d3 diameters of roll regions 40, 42 and 44, corresponding to headlap lanes h1, h2 and h3, are the same. In another embodiment, the d1, d2 and d3 diameters of roll regions 40, 42 and 44 could be different. Similarly, in this embodiment as shown in FIG. 3, the d4, d5 and d6 diameters of roll regions 46, 48 and 50, corresponding to prime lanes p1, p2 and p3, are the same. In another embodiment, the d4, d5 and d6 diameters of roll regions 46, 48 and 50 could be different.

While the top compression roll 32 shown in FIG. 3 illustrates various diameters d1, d2, d3, d4, d5 and d6 and the bottom compression roll 34 illustrates a constant diameter b1, in another embodiment the top compression roll 32 can have a constant diameter and the bottom compression roll 34 can have various diameters.

Figure 4:
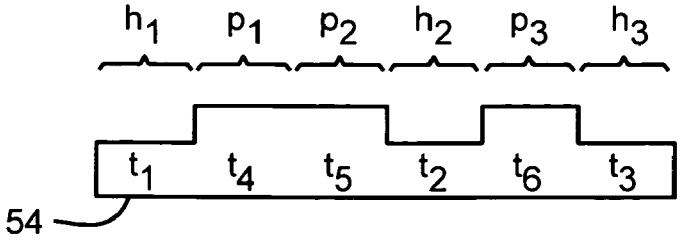
FIG. 4 is a side elevational view, in cross-section, of the asphalt-coated sheet downstream from the compression rolls of FIG. 3.

The asphalt-coated sheet 20 exits from the top compression roll 32 and the bottom compression roll 34 as a formed sheet 54 as shown in FIG. 4. Formed sheet 54 includes headlap lanes h1, h2 and h3 having thicknesses t1, t2 and t3, respectfully. Formed sheet 54 also includes prime lanes p1, p2 and p3 having thicknesses t4, t5 and t6, respectfully. In this embodiment, thicknesses t1, t2 and t3 are in a range from about 20 mils to about 70 mils. Alternatively, the thicknesses t1, t2 and t3 could be more than 70 mils or less than 20 mils. In this embodiment, thicknesses t4, t5 and t6 are in a range from about 40 mils to about 100 mils. Alternatively, the thicknesses t4, t5 and t6 could be more than 100 mils or less than 40 mils.

Figure 6:
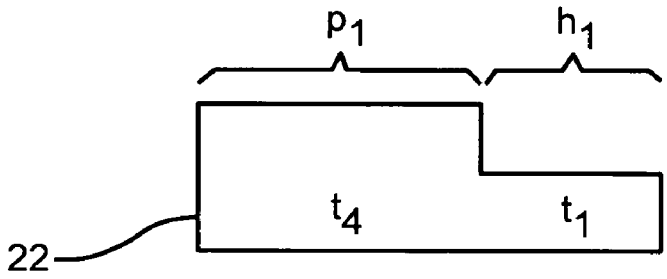
FIG. 6 is a side elevational view, in cross-section, of the shingle of FIG. 5.

As shown in FIGS. 5 and 6, after the roofing shingle 22 has been cut from the formed sheet 54, the roofing shingle 22 includes headlap lane h1 and prime lane p1. Headlap lane h1 has thickness t1 and prime lane p1 has thickness t4. In this embodiment, the thickness t1 is thinner than the thickness t4. In another embodiment, the thickness t1 may be the same as the thickness t4 or the thickness t1 may be more than the thickness t4. In one embodiment, the difference between the thickness t1 and the thickness t4 is at least 1 mil. In another embodiment, the difference between the thickness t1 and thickness t4 can be 1 mil or less than 1 mil.

As previously discussed, compression of the asphalt-coated sheet 20 between the top compression roll 32 and the bottom compression roll 34 squeezes excess asphalt material 18 from the asphalt-coated sheet 20. In this embodiment, the excess asphalt material 18 is recovered and recycled. By squeezing excess asphalt material 18 from the asphalt-coated sheet 20, a smaller amount of raw materials is necessary for the manufacture of composite shingles.

In addition to using a smaller amount of raw materials, the weight of the shingles can be reduced by squeezing excess asphalt material 18 from the asphalt-coated sheet 20. By reducing the weight of the shingles, the cost of raw materials and transportation of the manufactured shingles will be reduced. The excess asphalt material 18 can be squeezed from the asphalt-coated sheet by a thickness control mechanism. In this embodiment the thickness control mechanism comprises the top compression roll 32 and the bottom compression roll 34. In another embodiment, the thickness control mechanism can be any other assembly or mechanism sufficient to control the thickness of the asphalt-coated sheet 20. Referring again to FIG. 4, the thicknesses t1, t2, t3, t4, t5 and t6 formed by the top compression roll 32 and the bottom compression roll 34 can be controlled to provide the desired weights of the prime portions 26 and the headlap portions 24 in both the machine direction and the cross machine direction. In one embodiment, a shingle could have a prime portion 26 having a prime portion weight per square foot and a headlap portion 26 having a lesser headlap portion weight per square foot. Referring again to FIG. 1, as the formed sheet 54 exits the top compression roll 32 and the bottom compression roll 34, the weight of the formed sheet 54 is measured. The weight of the formed sheet 54 can be determined by any method, such as for example measuring the density of the asphalt using a scanner, suitable to determine the weight of the formed sheet 54. By measuring the weight of the formed sheet 54, the measured weight of the formed sheet 54 can be compared to the desired weight of the formed sheet 54 and adjustments, if necessary, can be made to the top and bottom compression rolls 32 and 34 to produce the desired thicknesses t1, t2, t3, t4, t5 and t6. It is to be understood that different shingle products can have different desired weights for the prime portions and the headlap portions. While in this embodiment the weight of the formed sheet 54 is determined downstream from the top and bottom compression rolls 32 and 34 respectfully, and it is to be understood that the weight of the shingle can be determined at other locations, such as for example after the granules have been deposited on the formed sheet 54, in the process.

An example of a lightweight shingle having varying weight regions is a shingle of the type disclosed in U.S. patent application Ser. No. 11/582,285 filed Oct. 17, 2006, which is hereby incorporated by reference, in its entirety. The disclosed lightweight shingle reduces the overall shingle weight by incorporating low density, lightweight headlap granules into the headlap region. In a preferred embodiment, a lightweight granule is used in combination with a thin headlap as described herein. In yet a further embodiment, the headlap granules are of a larger dimension than the prime granules to accomplish a more uniform overall sheet thickness, and more preferably the headlap granule comprises a lightweight granule.

Referring again to FIG. 1, the resulting multi-leveled, asphalt-coated formed sheet 54 is then passed beneath a series of granule applicators, hoppers or blenders 56 and 58 for dispensing granules to an upper surface of the formed sheet 54. The granule applicators 56 and 58 can be of any type suitable for depositing granules onto the formed sheet 54. An example of a granule blender is a granule blender of the type disclosed in U.S. Pat. No. 5,599,581 to Burton et al., which is hereby incorporated by reference, in its entirety. Additionally, a granule valve such as the granule valve disclosed in U.S. Pat. No. 6,610,147 to Aschenbeck may also be used. U.S. Pat. No. 6,610,147 to Aschenbeck is also incorporated by reference in its entirety. Although two granule blenders 56 and 58 are shown in the embodiment illustrated in FIG. 1, any suitable number and configuration of granule blenders can be used.

For example, a series of two blenders can be used, wherein the granule blender 56 can be used to deposit prime granules 57 on the prime lanes p1, p2 and p3. Similarly, the granule blender 58 can be used to apply headlap granules 59 on the headlap lanes h1, h2 and h3. Applying prime granules 57 and headlap granules defines a granule-covered sheet 62. In another embodiment, additional granule blenders can be used for additional granule drops, such as different colors, sharp demarcations and background granules.

As shown in FIG. 1, after all the granules are deposited on the asphalt-coated sheet 20, the granule-covered sheet 62 is turned around a slate drum 64 to press the granules into the asphalt coating and to temporarily invert the granule-covered sheet 62 so that the excess granules fall off. The excess granules are recovered and reused. The granule-covered sheet 62 is subsequently fed through a cutter 74 that cuts the granule-covered sheet 62 into individual shingles 22. The cutter 74 may be any type of cutter, such as for example a rotary cutter, sufficient to cut the granule-covered sheet 62 into individual shingles 22.

Figure 7:
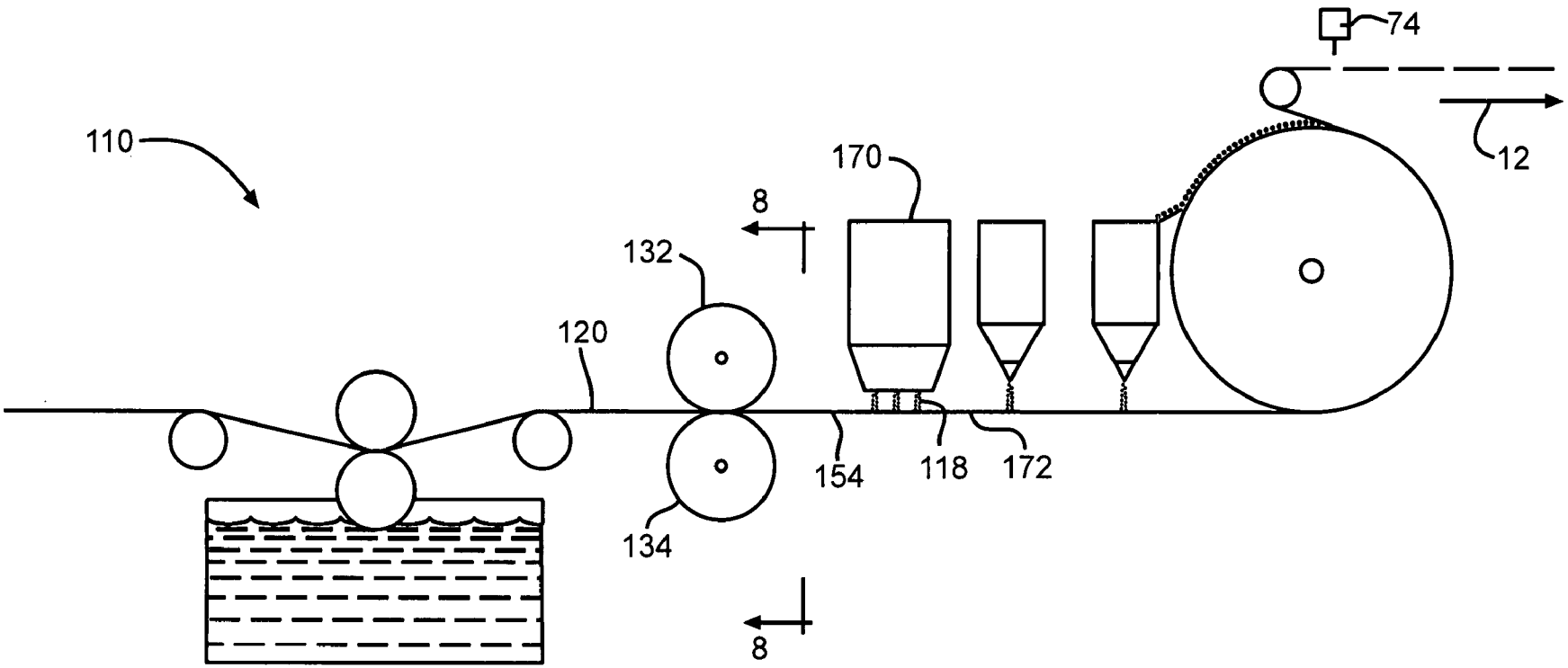
FIG. 7 is a schematic elevational view, partially in cross section, of a second embodiment of an apparatus for making shingles, the apparatus having an auxiliary coater.
Figure 8:
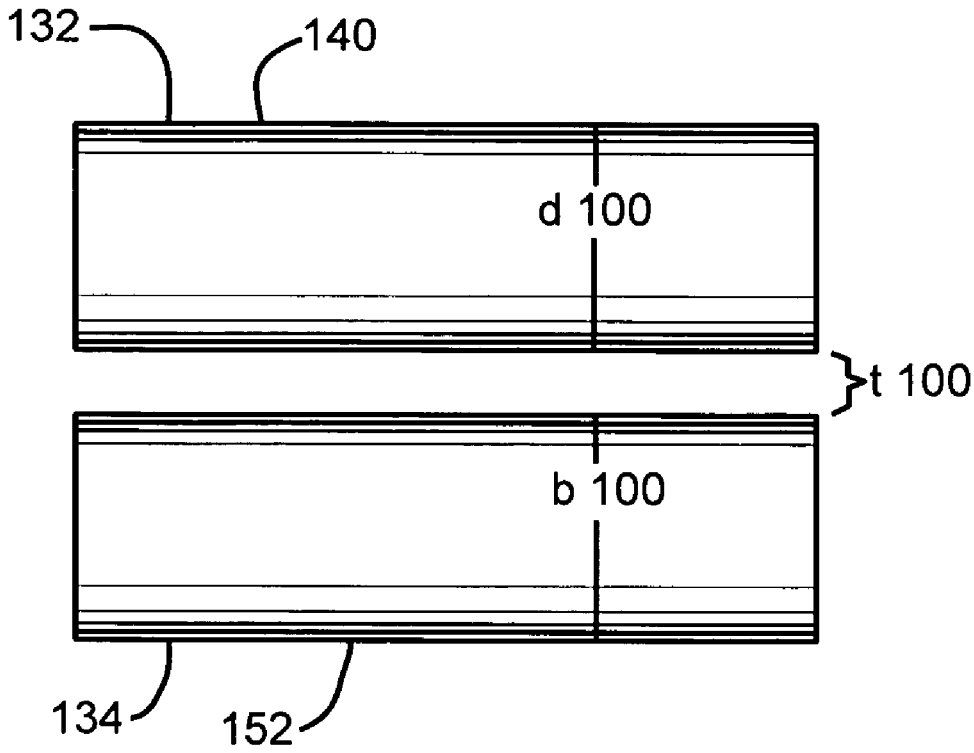
FIG. 8 is a side elevational view of the compression rolls, taken along the line 8-8, of FIG. 7.

In another embodiment, apparatus 110 for manufacturing an asphalt-based roofing shingle is shown in FIG. 7. An asphalt-coated sheet 120, including headlap lanes h1, h2 and h3 and prime lanes, p1, p2 and p3, is fed between a top compression roll 132 and a bottom compression roll 134. In this embodiment, the top compression roll 132 and the bottom compression roll 134 are rotating drums as shown in FIG. 8. Referring again to FIG. 7, as the asphalt-coated sheet 120 feeds between the top compression roll 132 and the bottom compression roll 134, the asphalt-coated sheet 120 is compressed and excess asphalt is squeezed from the asphalt-coated sheet 120.

As shown in FIG. 8, the top compression roll 132 comprises a single roll region 140 having a consistent roll diameter d100. Similarly, the bottom compression roll 134 has a single bottom roll region 152 having a consistent bottom roll diameter b100.

Referring again to FIG. 7, in operation, as the asphalt-coated sheet 120 passes between the top compression roll 132 and the bottom compression roll 134, the headlap lanes h1, h2 and h3 of the asphalt-coated sheet 120, and the prime lanes p1, p2, and p3 pass between roll region 140 of the top compression roll 132 and roll region 152 of the bottom compression roll 134. As the headlap lanes h1, h2 and h3 and the prime lanes p1, p2, and p3 pass between roll region 140 of the top compression roll 132 and roll region 152 of the bottom compression roll 134, the headlap lanes h1, h2 and h3 and the prime lanes p1, p2, and p3 are compressed to thickness t100.

In this embodiment, the top compression roll 132 and the bottom compression roll 134 compress the asphalt-coated sheet 120 to a uniform consistent thickness t100.

Figure 9:
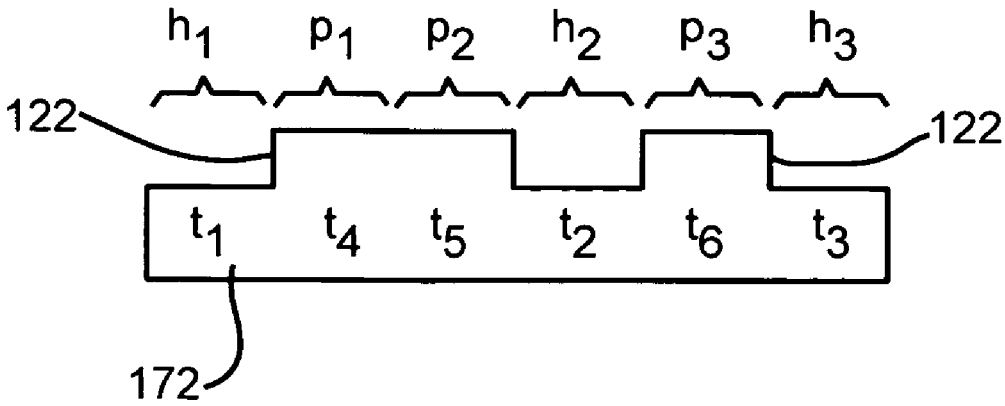
FIG. 9 is a side elevational view, in cross-section, of the asphalt-coated sheet downstream from the compression rolls of FIG. 8.

The asphalt-coated sheet 120 exits the compression of the top compression roll 132 and the bottom compression roll 134 as a formed sheet 154 as shown in FIG. 7. Formed sheet 154 includes headlap lanes h1, h2 and h3 and prime lanes p1, p2 and p3, each having thicknesses t100. The formed sheet 154 passes under an auxiliary coater 170. In this embodiment, the auxiliary coater 170 is configured to impart additional asphalt material 118 onto the top of the prime lanes p1, p2, and p3 of the formed sheet 154, forming an additional layer 122, shown in FIG. 9. After depositing the additional layer 122 of asphalt material 118 on the top of the prime lanes p1, p2, and p3, the formed sheet 154 becomes layered sheet 172 as illustrated in FIG. 9. As shown in FIG. 9, the prime lanes p1, p2 and p3 have a thickness t4, t5 and t6, respectfully. In this embodiment, thicknesses t1, t2 and t3 are in a range from about 20 mils to about 70 mils. Alternatively, the thicknesses t1, t2 and t3 could be more than 70 mils or less than 20 mils. In this embodiment, thicknesses t4, t5 and t6 are in a range from about 40 mils to about 100 mils. Alternatively, the thicknesses t4, t5 and t6 could be more than 100 mils or less than 40 mils. In this embodiment, the auxiliary coater 170 is a mechanism that sprays an additional layer 122 of asphalt material 118 onto the prime lanes p1, p2, and p3. Alternatively, the additional layer 122 of asphalt material 118 can be applied to the formed sheet 154 in another manner, such as by a dispenser or an extruder, or by any other manner sufficient to deposit an additional layer 122 of asphalt material 118 onto the prime lanes p1, p2, and p3. In one such embodiment, the additional asphalt 118 is a weathering asphalt, and the initial asphalt coating is a less weatherable asphalt, thereby further reducing the cost of the asphalt used in the shingle construction. Alternatively, the first asphalt utilizes a higher filler level and/or the additional asphalt 118 may include additional additives or comprise an adhesive material to retain the granules or provide impact resistance as described in commonly assigned U.S. Pat. No. 6,426,309, which is incorporated herein by reference in its entirety.

Figure 10:
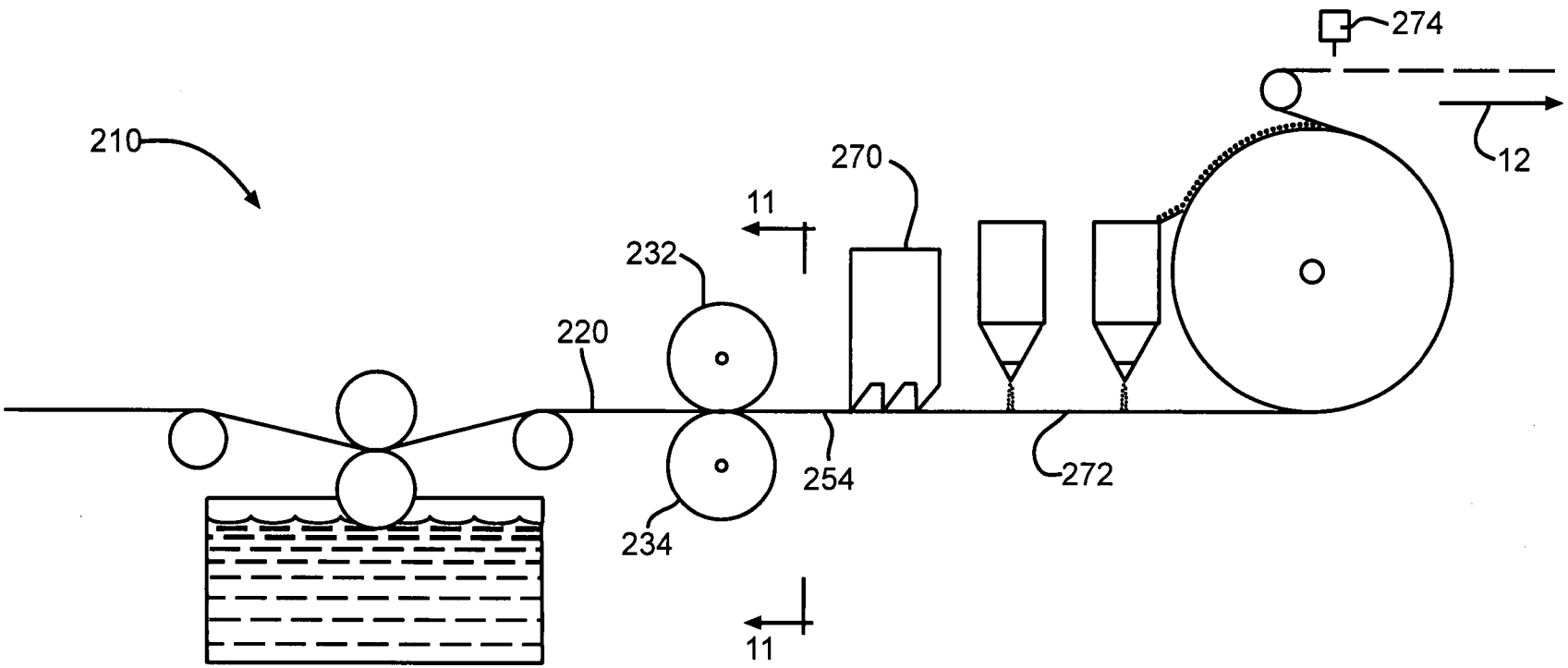
FIG. 10 is a schematic elevational view, partially in cross section, or a third embodiment of an apparatus for making shingles, the apparatus having an asphalt removal unit.
Figure 11:
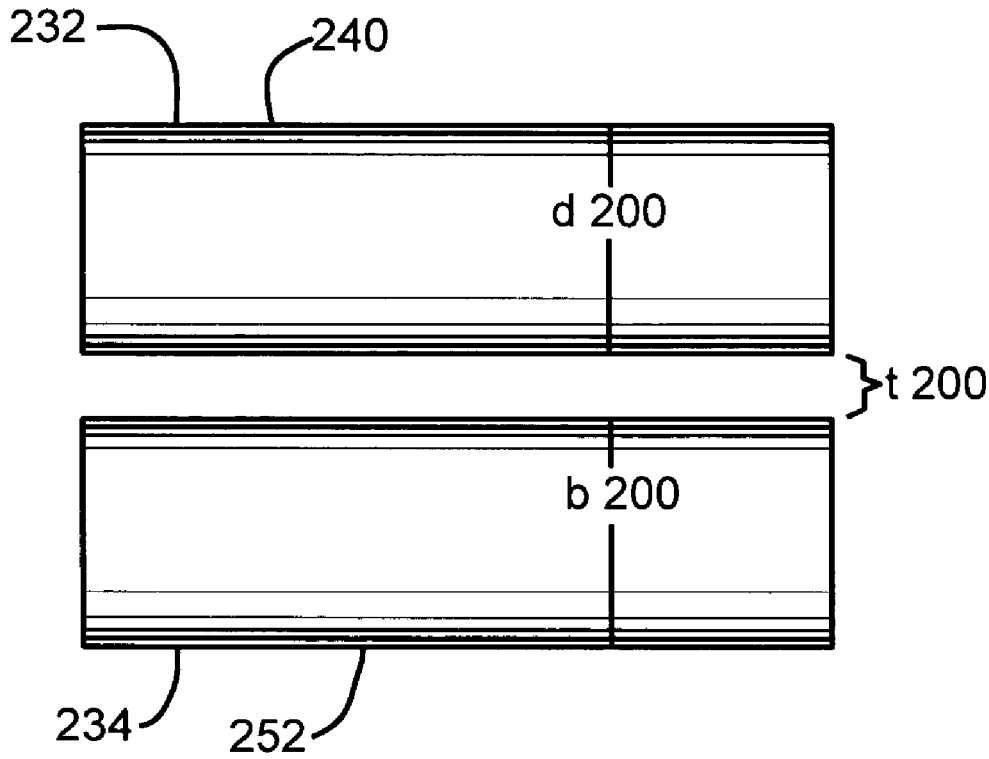
FIG. 11 is a side elevational view of the compression rolls, taken along the line 11-11, of FIG. 10.

In yet another embodiment, apparatus 210 for manufacturing an asphalt-based roofing shingle is shown in FIG. 10. An asphalt-coated sheet 220, including headlap lanes h1, h2 and h3 and prime lanes, p1, p2 and p3, is fed between a top compression roll 232 and a bottom compression roll 234. In this embodiment, the top compression roll 232 and the bottom compression roll 234 are rotating drums as shown in FIG. 11. Referring again to FIG. 10, as the asphalt-coated sheet 220 feeds between the top compression roll 232 and the bottom compression roll 234, the asphalt-coated sheet 220 is compressed and excess asphalt is squeezed from the asphalt-coated sheet 220.

As shown in FIG. 11, the top compression roll 232 comprises a single roll region 240 having a consistent roll diameter d200. Similarly, the bottom compression roll 234 has a single bottom roll region 252 having a consistent bottom roll diameter b200.

Referring again to FIG. 10, in operation, as the asphalt-coated sheet 220 passes between the top compression roll 232 and the bottom compression roll 234, the headlap lanes h1, h2 and h3 of the asphalt-coated sheet 220, and the prime lanes p1, p2, and p3 pass between roll region 240 of the top compression roll 232 and roll region 252 of the bottom compression roll 234. As the headlap lanes h1, h2 and h3 and the prime lanes p1, p2, and p3 pass between roll region 240 of the top compression roll 232 and roll region 252 of the bottom compression roll 234, the headlap lanes h1, h2 and h3 and the prime lanes p1, p2, and p3 are compressed to thickness t200. In this embodiment, the top compression roll 232 and the bottom compression roll 234 compress the asphalt-coated sheet 220 to a uniform consistent thickness t200.

Figure 12:
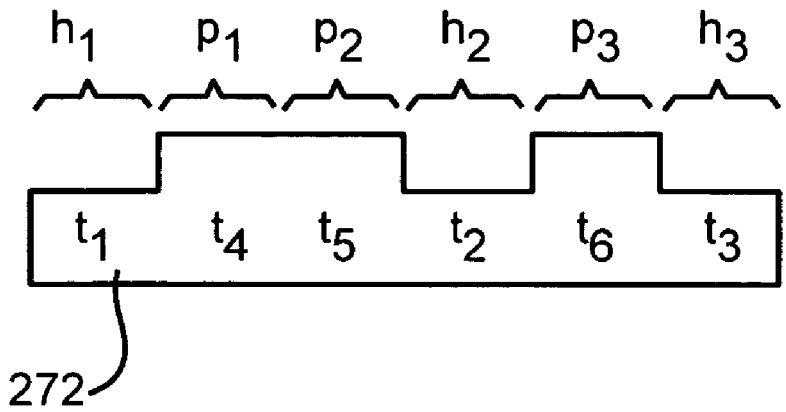
FIG. 12 is a side elevational view, in cross-section, of the asphalt-coated sheet downstream from the compression rolls of FIG. 10.

The asphalt-coated sheet 220 exits the compression of the top compression roll 232 and the bottom compression roll 234 as a formed sheet 254 as shown in FIG. 10. Formed sheet 254 includes headlap lanes h1, h2 and h3 and prime lanes p1, p2 and p3, each having thicknesses t200. The formed sheet 254 passes under an asphalt remover 270. In this embodiment, the asphalt remover 270 is configured to remove a layer of asphalt material from the top of the headlap lanes h1, h2, and h3 of the formed sheet 254. After removing a layer of asphalt material from the top of the headlap lanes h1, h2, and h3, the formed sheet 254 becomes layered sheet 272 as illustrated in FIG. 12. As shown in FIG. 12, the prime lanes p1, p2 and p3 have a thickness t4, t5 and t6, respectfully. In this embodiment, thicknesses t1, t2 and t3 are in a range from about 20 mils to about 70 mils. Alternatively, the thicknesses t1, t2 and t3 could be more than 70 mils or less than 20 mils. In this embodiment, thicknesses t4, t5 and t6 are in a range from about 40 mils to about 100 mils. Alternatively, the thicknesses t4, t5 and t6 could be more than 100 mils or less than 40 mils.

In this embodiment as shown in FIG. 10, the asphalt remover 270 is a scraper having one or more scraping blades. In another embodiment, the asphalt remover 270 could be any mechanism, structure or assembly, such as an abrasive wheel or a suction device, sufficient to remove a layer of asphalt material from one or more of the top and/or bottom of the headlap lanes h1, h2 and h3. Alternatively, the outboard lanes h1 and h3 may be reduced in thickness, or the center lane h2 may be of reduced thickness.

Figure 13:
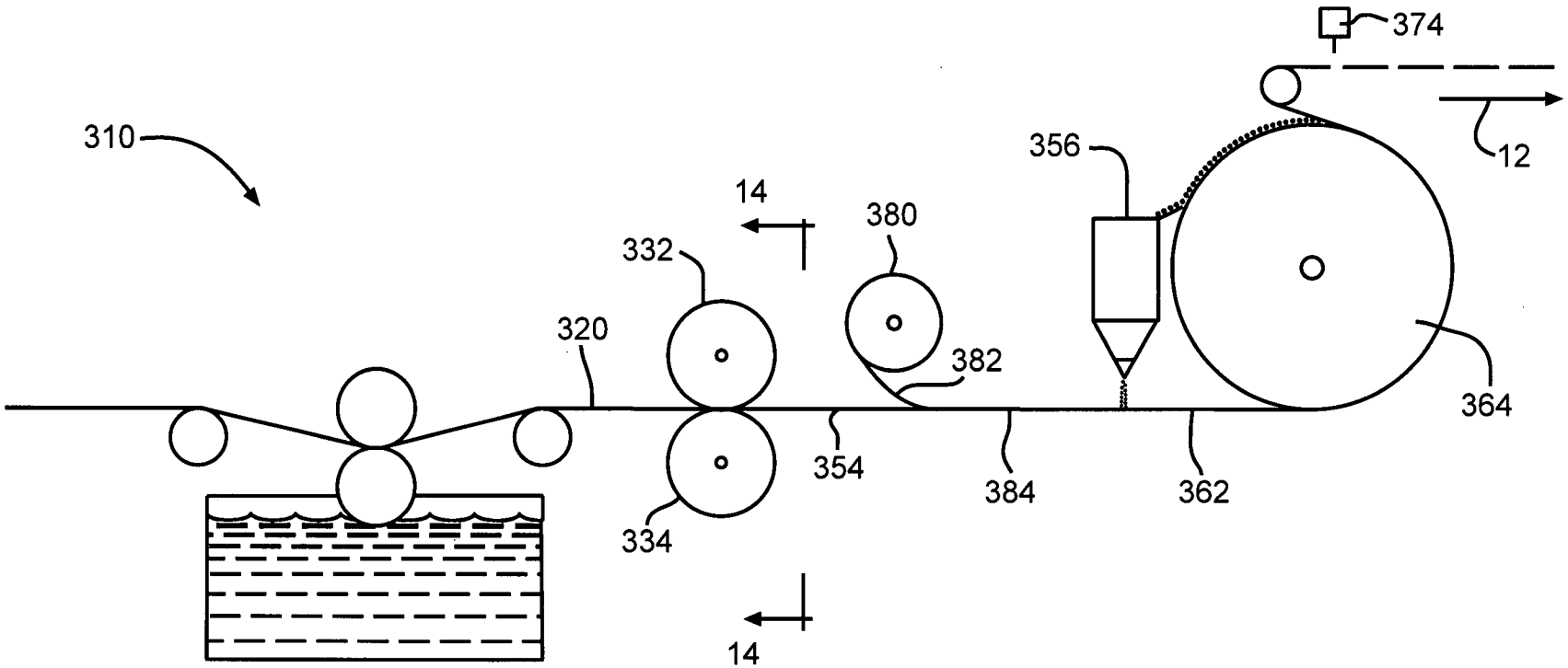
FIG. 13 is a schematic elevational view, partially in cross section, of a fourth embodiment of an apparatus for making shingles, the apparatus having a laminator.
Figure 14:
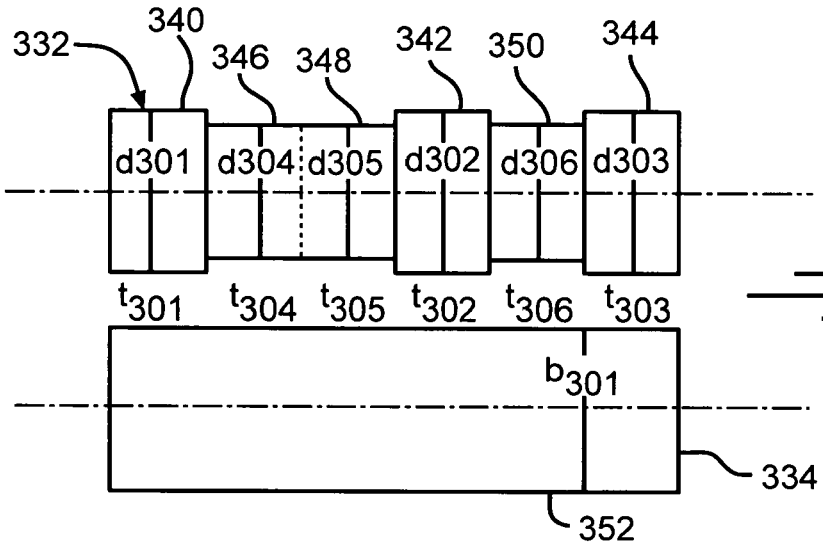
FIG. 14 is a side elevational view of the compression rolls, taken along the line 14-14, of FIG. 13.

In yet another embodiment, apparatus 310 for manufacturing an asphalt-based roofing shingle is shown in FIG. 13. A resulting asphalt-coated sheet 320, including headlap lanes h1, h2 and h3 and prime lanes, p1, p2 and p3, is then passed between a top compression roll 332 and a bottom compression roll 334. In this embodiment, the top compression roll 332 and the bottom compression roll 334 are rotating drums as shown in FIG. 14. Referring again to FIG. 13, as the asphalt-coated sheet 320 feeds between the top compression roll 32 and the bottom compression roll 334, the asphalt-coated sheet 320 is compressed and excess asphalt is squeezed from the asphalt-coated sheet 320.

As shown in FIG. 14, the top compression roll 332 comprises different roll regions having different roll diameters that correspond to the headlap and prime lanes of the asphalt-coated sheet 320. In this embodiment, the top compression roll 332 includes roll regions 340, 342 and 344. Roll region 340 has a roll diameter d301, roll region 342 has a roll diameter d302 and roll region 344 has a roll diameter d303. The top compression roll 332 also includes roll regions 346, 348 and 350. Roll region 346 has a roll diameter d304, roll region 348 has a roll diameter d305 and roll region 350 has a roll diameter d306.

In this embodiment as further shown in FIG. 14, the bottom compression roll 334 has a bottom roll region 352. The bottom roll region 352 has a bottom roll diameter b301.

In operation, as the asphalt-coated sheet 320 passes between the top compression roll 332 and the bottom compression roll 334, headlap lanes h1 of the asphalt-coated sheet 320 passes between roll region 340 of the top compression roll 332 and roll region 352 of the bottom compression roll 334. As the headlap lane h1 passes between roll region 340 of the top compression roll 332 and roll region 352 of the bottom compression roll 334, the headlap lane h1 is compressed to thickness t301. In a similar manner, as headlap lanes h2 and h3 pass between roll regions 342 and 344 of the top compression roll 332 and roll region 352 of the bottom compression roll 334, headlap lanes h2 and h3 are compressed to thicknesses t302 and t303. Also in a similar manner, as prime lanes p1, p2 and p3 pass between roll regions 346, 348 and 350 of the top compression roll 332 and roll region 352 of the bottom compression roll 334, prime lanes p1, p2 and p3 are compressed to thicknesses t304, t305 and t306. In this embodiment as shown in FIG. 14, the d301, d302 and d303 diameters of roll regions 340,342 and 344, corresponding to headlap lanes h1, h2 and h3, are the same. In another embodiment, the d301, d302 and d303 diameters of roll regions 340, 342 and 344 could be different. Similarly, in this embodiment as shown in FIG. 14, the d304, d305 and d306 diameters of roll regions 346, 348 and 350, corresponding to prime lanes p1, p2 and p3, are the same. In another embodiment, the d304, d305 and d306 diameters of roll regions 346, 348 and 350 could be different.

Figure 15:
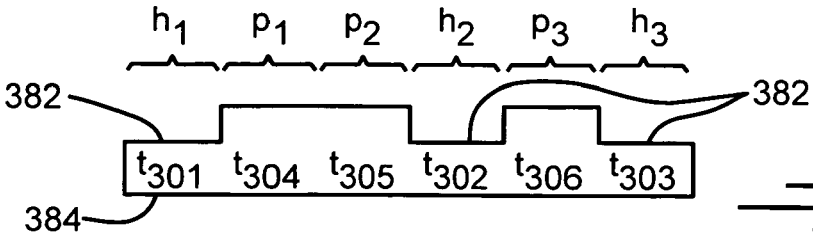
FIG. 15 is a side elevational view, in cross-section, of the asphalt-coated sheet downstream from the compression rolls of FIG. 13.

The asphalt-coated sheet 320 exits the compression of the top compression roll 332 and the bottom compression roll 334 as a formed sheet 354 as shown in FIG. 15. Formed sheet 354 includes headlap lanes h1, h2 and h3 having thicknesses t301, t302 and t303. Formed sheet 354 also includes prime lanes p1, p2 and p3 having thicknesses t304, t305 and t306. In this embodiment, thicknesses t301, t302 and t303 are in a range from about 20 mils to about 70 mils. Alternatively, the thicknesses t301, t302 and t303 could be more than 70 mils or less than 20 mils. In this embodiment, thicknesses t304, t305 and t306 are in a range from about 40 mils to about 100 mils. Alternatively, the thicknesses t304, t305 and t306 could be more than 100 mils or less than 40 mils.

Referring again to FIG. 13, formed sheet 354 is then passed underneath a film application unit 380. The film application unit 380 is configured to apply a film 382 to the headlap lanes h1, h2, and h3. The film 382 is configured to strengthen the headlap lanes h1, h2 and h3. By applying the film 382 to the headlap lanes h1, h2 and h3, the step of applying granules to the headlap lanes h1, h2 and h3 can be eliminated, thereby resulting in a more lightweight shingle. More lightweight shingles can result in reduced transportation costs and reduced labor costs. As shown in FIG. 13, the film 382 is made of a vinyl or PVC film. Alternatively, the film 382 can be another material, such as polyester, PVA polypropylene, metallic foil, fabric or any other material sufficient to strengthen the headlap lanes h1, h2, and h3. The film 382 can be made of fibers or reinforced with fibers. The film 382 can comprise a material that is tacky for the granules, or the film 382 can be a material to which the granules do not readily adhere.

After passing underneath the film application unit 380, the formed sheet 354 becomes a filmed sheet 384. The filmed sheet 384 passes beneath a granule hopper 356 for dispensing granules to the prime lanes p1, p2 and p3. Although a single granule blender 356 is shown in the embodiment illustrated in FIG. 13, any suitable number and configuration of granule blenders, including an applicator for background granules, can be used.

As shown in FIG. 13, after the granules are deposited on the prime lanes p1, p2, and p3 of the laminated sheet 384, the granule-covered sheet 362 is turned around a slate drum 364 to press the granules into the asphalt coating and to temporarily invert the granule-covered sheet 362 so that the excess granules fall off. The excess granules are recovered and reused. The granule-covered sheet 362 is subsequently fed through a cutter 374 that cuts the granule-covered sheet 362 into individual shingles.

The principle and mode of operation of this invention have been described in its preferred embodiments. However, it should be noted that this invention may be practiced otherwise than as specifically illustrated and described without departing from its scope.

What is claimed is:

1. A method of manufacturing roofing shingles comprising the steps of:

coating a continuously supplied shingle mat with roofing asphalt to make an asphalt-coated sheet, the asphalt-coated sheet having at least one prime portion and at least one headlap portion;

varying the thickness of the asphalt-coated sheet by passing the asphalt-coated sheet through compression rollers configured to compress the asphalt-coated sheet such that the at least one prime portion has a first thickness and the at least one headlap portion has a second thickness, different from the first thickness wherein compressing the asphalt-coated sheet forms a formed sheet;

applying granules onto the formed sheet to form a granule-covered sheet; and cutting the granule-covered sheet into shingles.

2. The method of claim 1 in which the compression rollers comprise regions having different diameters.

3. The method of claim 1 in which the thickness of the headlap portion is less than the thickness of the prime portion.

4. The method of claim 1 in which the thickness of the prime portion is in a range from about 40 mils to about 100 mils.

5. The method of claim 1 in which the thickness of the headlap portion is in a range from about 20 mils to about 70 mils.

6. The method of claim 1, wherein the compression rollers include at least one top compression roller and a bottom compression roller.

7. The method of claim 6, wherein the top compression roller has regions of different roll diameters.

8. The method of claim 7, wherein the bottom compression roller has a bottom roll diameter that is constant across an entire width of the bottom compression roller.

9. The method of claim 1, wherein the compression rollers squeeze excess roofing asphalt from the asphalt-coated sheet.

10. The method of claim 9, wherein the excess roofing asphalt is squeezed from the asphalt-coated sheet by a thickness control mechanism.

11. The method of claim 10, wherein the thickness control mechanism is configured to control the weight of the prime portion and the headlap portion of the asphalt-coated sheet.

12. The method of claim 11, wherein the thickness control mechanism determines the weight of the prime and headlap portions by determining the density of the asphalt.

13. The method of claim 12, wherein the thickness control mechanism determines the weight of the prime and headlap portions after the granules have been deposited on the asphalt-coated sheet.

14. A method of manufacturing roofing shingles comprising the steps of:

coating a continuously supplied shingle mat with roofing asphalt to make an asphalt-coated sheet, the asphalt-coated sheet having at least one prime portion and at least one headlap portion;

varying the thickness of the asphalt-coated sheet by passing the asphalt-coated sheet through top and bottom compression rollers, the top compression roller having regions of different diameters and the bottom compression roller having a diameter that is constant across an entire width of the bottom compression roller, the top and bottom compression rollers configured to compress the asphalt coated sheet such that the at least one prime portion has a first thickness and the at least one headlap portion has a second thickness, different from the first thickness wherein compressing the asphalt-coated sheet forms a formed sheet;

applying granules onto the formed sheet to form a granule-covered sheet; and cutting the granule-covered sheet into shingles.

15. The method of claim 14 in which the thickness of the headlap portion is less than the thickness of the prime portion.

16. The method of claim 14 in which the thickness of the prime portion is in a range from about 40 mils to about 100 mils.

17. The method of claim 14 in which the thickness of the headlap portion is in a range from about 20 mils to about 70 mils.

18. The method of claim 14, wherein the top and bottom compression rollers squeeze excess roofing asphalt from the asphalt-coated sheet.

19. The method of claim 18, wherein the excess roofing asphalt is squeezed from the asphalt-coated sheet by a thickness control mechanism.

20. The method of claim 19, wherein the thickness control mechanism is configured to control the weight of the prime portion and the headlap portion of the asphalt-coated sheet.

21. The method of claim 20, wherein the thickness control mechanism determines the weight of the prime and headlap portions by determining the density of the asphalt.

22. The method of claim 21, wherein the thickness control mechanism determines the weight of the prime and headlap portions after the granules have been deposited on the asphalt-coated sheet.

23. A method of manufacturing roofing shingles comprising the steps of:

coating a continuously supplied shingle mat with hot roofing asphalt to make an asphalt-coated sheet, the asphalt-coated sheet having at least one prime portion and at least one headlap portion;

varying the thickness of the asphalt-coated sheet by passing the asphalt-coated sheet through top and bottom compression rollers while the roofing asphalt remains hot, the top compression roller having regions of different diameters and the bottom compression roller having a diameter that is constant across an entire width of the bottom compression roller, the top and bottom compression rollers configured to compress the asphalt coated sheet such that the at least one prime portion has the first thickness and the at least one headlap portion has the second thickness, wherein compressing the asphalt-coated sheet forms a formed sheet;

applying granules onto the formed sheet to form a granule-covered sheet; and cutting the granule-covered sheet into shingles.

* * * * *